US006592467B1

(12) United States Patent
Gray

(10) Patent No.: US 6,592,467 B1
(45) Date of Patent: Jul. 15, 2003

(54) PUTTER BLADE

(75) Inventor: William Patrick Gray, Greenville, SC (US)

(73) Assignee: Focus Golf Systems, Inc., Greenville, SC (US)

( * ) Notice: Subject to any disclaimer, the term of this patent is extended or adjusted under 35 U.S.C. 154(b) by 0 days.

(21) Appl. No.: 10/052,132

(22) Filed: Jan. 17, 2002

(51) Int. Cl.[7] ..... A63B 53/04; A63B 53/08

(52) U.S. Cl. ..... 473/332; 473/337; 473/340

(58) Field of Search ..... 473/334, 335, 473/336, 337, 338, 339, 324, 327, 349, 329, 332, 256, 340, 341

(56) References Cited

U.S. PATENT DOCUMENTS

| | | | | |
|---|---|---|---|---|
| 780,776 | A | | 1/1905 | Brown |
| 1,336,671 | A | | 4/1920 | Backus |
| 1,337,958 | A | | 4/1920 | Reach |
| 1,414,124 | A | | 4/1922 | Griffin |
| 1,485,685 | A | * | 3/1924 | McMahon |
| 1,538,312 | A | * | 5/1925 | Beat |
| 1,854,548 | A | | 4/1932 | Hunt |
| RE19,178 | E | * | 5/1934 | Spiker |
| 3,003,768 | A | | 10/1961 | Clements |
| 3,652,094 | A | * | 3/1972 | Glover |
| 3,794,328 | A | | 2/1974 | Gordon |
| 3,819,180 | A | | 6/1974 | Murphy |
| 4,206,924 | A | * | 6/1980 | Koralik |
| 4,679,792 | A | * | 7/1987 | Straza |
| 4,693,478 | A | * | 9/1987 | Long |
| 4,730,830 | A | * | 3/1988 | Tilley |
| 5,054,784 | A | | 10/1991 | Collins |
| 5,158,296 | A | | 10/1992 | Lee |
| 5,344,149 | A | * | 9/1994 | Miller |
| 5,489,097 | A | * | 2/1996 | Simmons |
| 5,524,890 | A | | 6/1996 | Kim et al. |
| 5,529,303 | A | | 6/1996 | Chen |
| 5,681,227 | A | | 10/1997 | Sayrizi |
| 5,700,208 | A | | 12/1997 | Nelms |
| 5,766,093 | A | * | 6/1998 | Rohrer |
| 5,807,187 | A | | 9/1998 | Hamm |
| 5,839,974 | A | * | 11/1998 | McAllister |
| 6,001,029 | A | | 12/1999 | Kobayashi |
| D419,214 | S | | 1/2000 | Hamm |
| D421,081 | S | | 2/2000 | Antonious |
| 6,165,080 | A | | 12/2000 | Salisbury |
| 6,224,497 | B1 | | 5/2001 | Antonious |

* cited by examiner

*Primary Examiner*—Sebastiano Passaniti
(74) *Attorney, Agent, or Firm*—McNair Law Firm, P.A.

(57) ABSTRACT

A putter head formed of a first material having a heel, a toe, a back, a top, a sole and a face forming the designated impact surface with a golf ball. The face comprising a generally planar surface extending from the heel to the toe and from the top to the sole. A plurality of horizontal rows of apertures are formed along substantially horizontal planes through the face into a body area between the face and the back. The apertures are formed to selected and different depths depending upon their location on the face. A filler of selected weight per unit area may be added to selected apertures. A putter head of selected weight, balance and feel is provided.

16 Claims, 4 Drawing Sheets

PUTTER BLADE

BACKGROUND OF THE INVENTION

This instant invention is directed to an improved putter, more particularly an improved putter head.

Golf clubs have long been designed with the intention of providing improved touch or feel. Generally the approach to solving this problem is to modify the grip, shaft, face or by providing inserts.

The instant invention has its primary object a putter head constructed with the capability of being adjusted to have the most optimum weight, the optimum weight distribution for the individual user and a desired ball striking surface.

Another object of the invention is to provide a putter head with a plurality of aligned rows of apertures of selected depth formed in the putter face providing the ball striking surface with a softened impact with the golf ball.

Another object of the invention is the provision of a putter head with selected heel and toe balancing.

Another object of the invention is a putter head with selected sole to top weight distribution.

Another object of the invention is a putter head in which the weight and weight distribution can be readjusted as desired.

Another object of the invention is a putter head in which the balance between head/toe or top/sole may be individually adjusted as desired.

SUMMARY OF THE INVENTION

The disclosed invention is directed to an improved putter and putter head. The putter head, which is formed of a first material, includes a heel, a toe, a face, a back, a top and a sole. The face, which forms the designated impact surface which extends from the heel to the toe and from the top to the sole. There are a plurality of horizontal rows of apertures formed along substantially horizontal plans through the face and into the body area between the face and the back. The apertures are formed to different depths depending upon their location on the face.

A filler, of a second material having a weight per unit volume different and preferably greater than the weight per unit volume of the first material, may be inserted into selected of the apertures at least partially filling certain of them. Usually these selected apertures comprise the apertures adjacent the toe and the heel and/or the lower horizontal row of apertures.

The apertures may be formed to different depths between horizontal plans, between spaced vertical planes, or along a single horizontal and vertical plane. Also, selected certain apertures may be formed to selected different depths.

The apertures may be filled with varying amounts of the filler, however, the apertures are preferably never filled to be even with the plane of the face.

The putter head may be a blade type putter head, a cavity back putter head or any other of the common designs.

The apertured face provides a surface which strikes the golf ball with a softened impact while providing greater feel. The selected aperture depth along with the selected volume of filler provides a selected desired weight and balance.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1A:
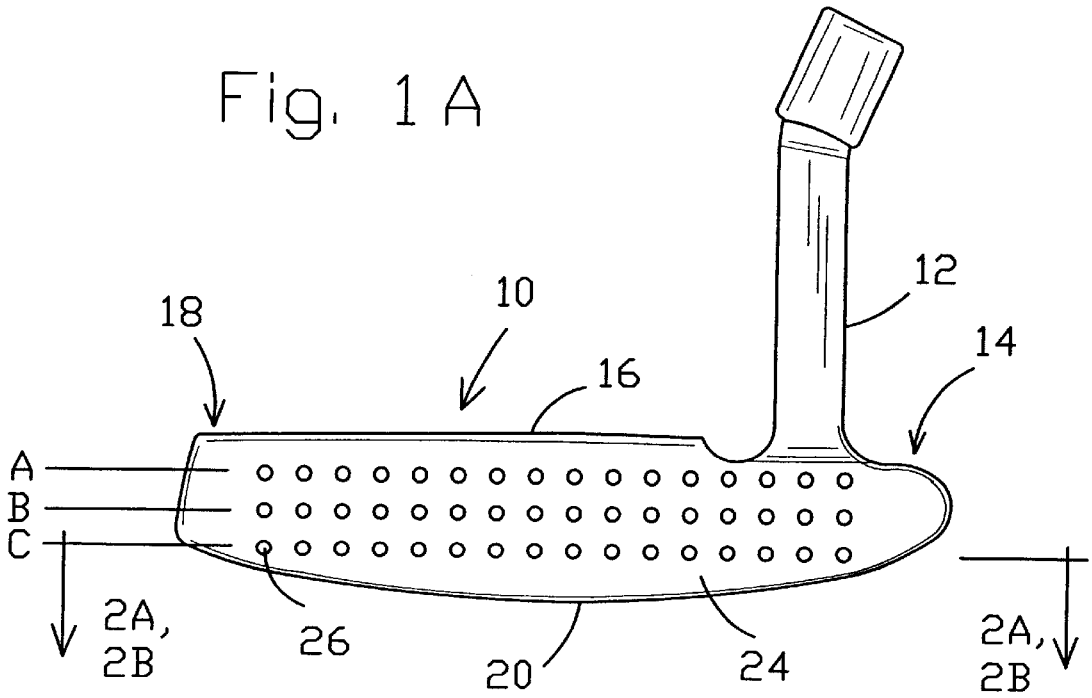
FIG. 1A is a plane view of the face of the putter head of the invention.
Figure 4:
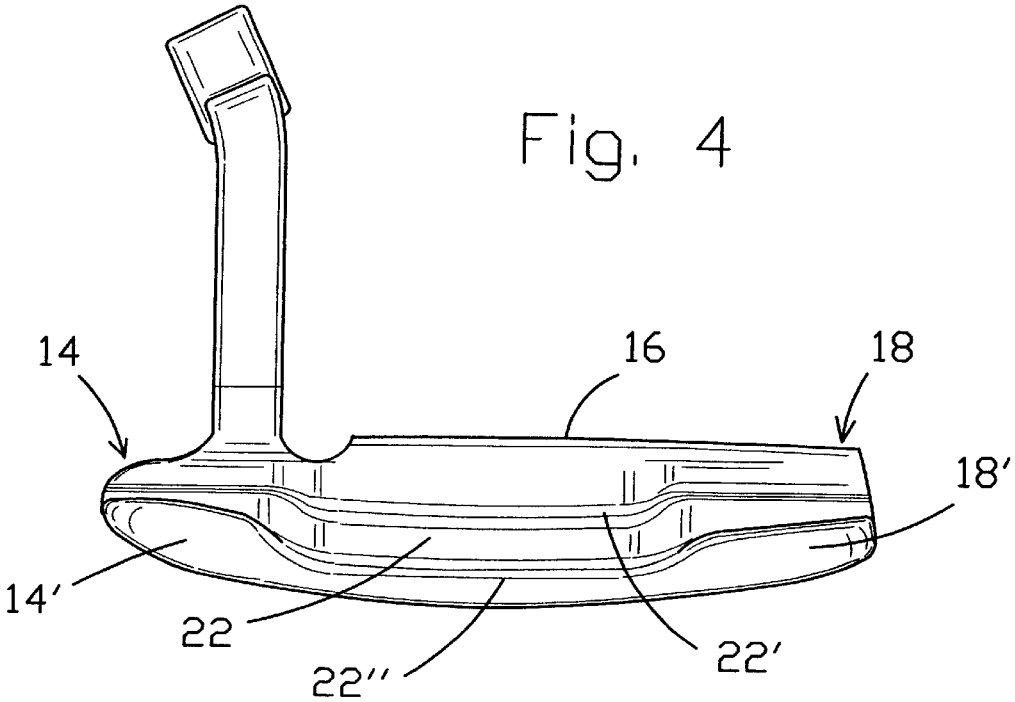
FIG. 4 is a plane rear view of the putter head of FIG. 1A or B.

Referring now in more detail to the drawings, the invention will now be described in more detail.

Turning to FIGS. 1A, 1B, 4, 5 and 6, a general configuration of a putter head constructed to include the apertured face of the invention is shown. Specifically, putter head 10, 10' includes hosel 12 which connects with top 16 of the putter head adjacent its heel 14. The other components forming the putter head are toe 18, sole 20, back 22 and face 24. Putter head 16 as shown is of a usual configuration with a shaped back having spaced wedges 14', 18' forming weighted portions at the heel and toe. The sole 20 presents a slightly convex surface while top 16 is generally flat. The back is formed with plate 22' which is of a width equal the weight of sole 20 and ridge or ledge 22" which is above the plate and of less width. Both extend from heel 14 to toe 18. This structure is generally common in the art. It is noted that the putter head could be of a cavity back design, it could be of any known blade design or any known other design and still accommodate the structure to achieve the object and function of the invention.

Figure 1B:
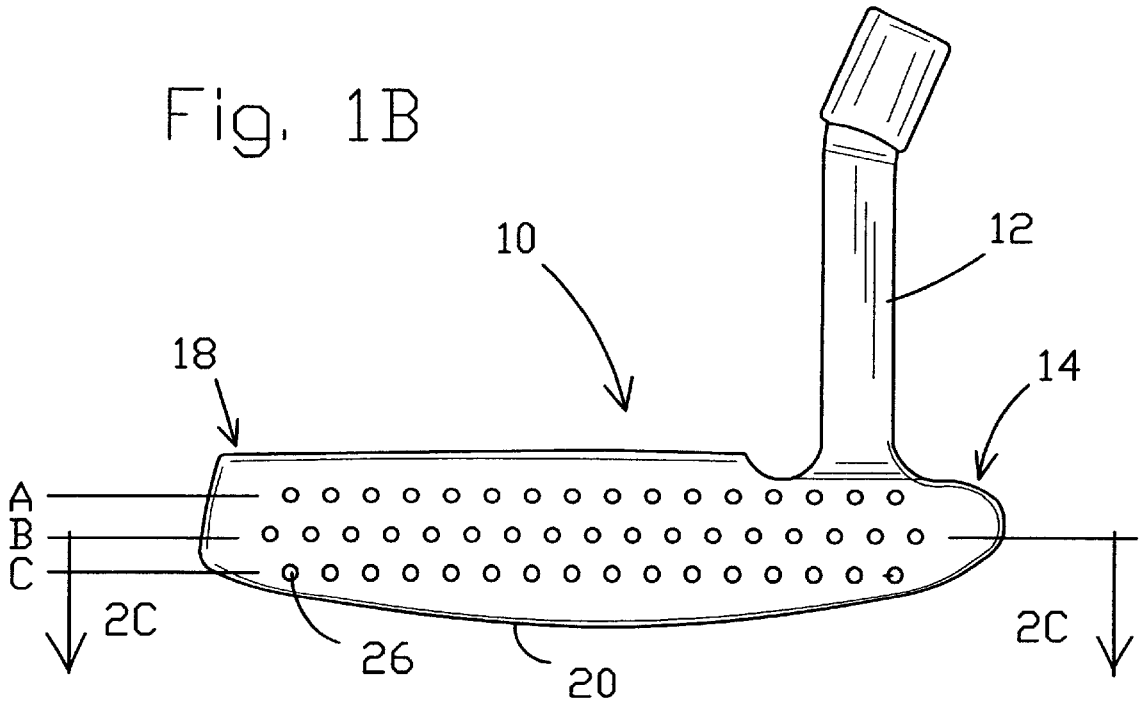
FIG. 1B is a plane view of a second arrangement of the putter head of FIG. 1A.

Turning now more specifically to FIG. 1A, the putter face 24 which comprised the designated impact surface is formed with three rows of apertures or holes 26 formed along horizontal rows A, B and C. As shown, each aperture 26 is of equal diameter, between 1/16 and 3/16, The apertures are equally spaced both horizontally and vertically and are in vertically aligned rows. Alternately, apertures 26 could be formed along horizontal and diagonal rows as shown in FIG. 1B. Either arrangement accomplishes the desired result. The desired spacing between horizontally and vertically aligned apertures is about 1/4 which the spacing between diagonally aligned apertures may be slightly more. It is important that the apertures be spaced sufficiently close and that their diameter be sufficiently small so as to insure that the actual impact surface of face 24 is sufficiently even or uniform to evenly strike the surface of the golf ball and propel it in the desired direction.

Figure 2B:
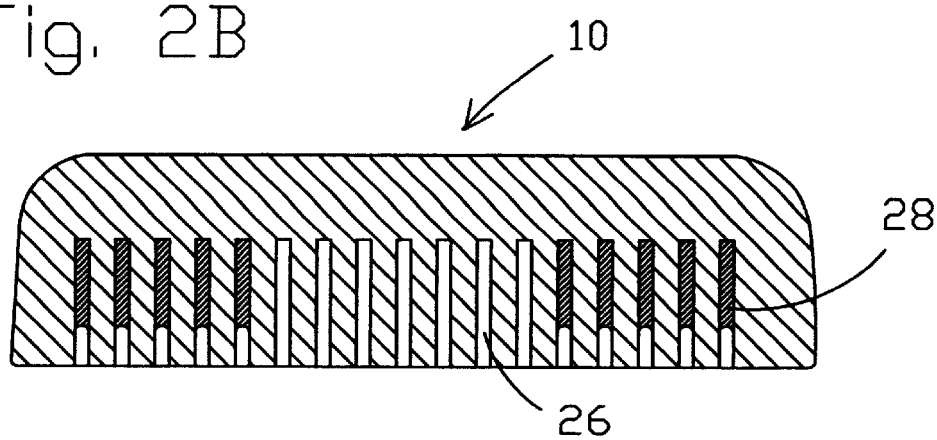
FIG. 2B is a top sectional view taken along line 2B of FIG. 1A showing a second arrangement of the aperture.
Figure 2C:
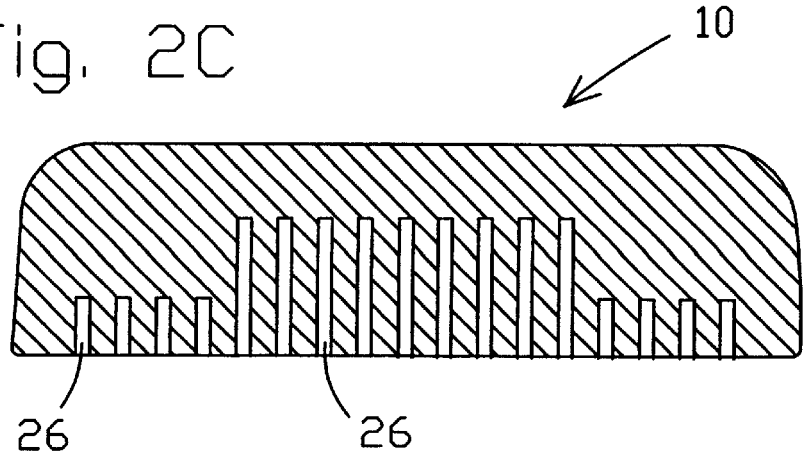
FIG. 2C is a top sectional view taken along line 2C of FIG. 1B.
Figure 2A:
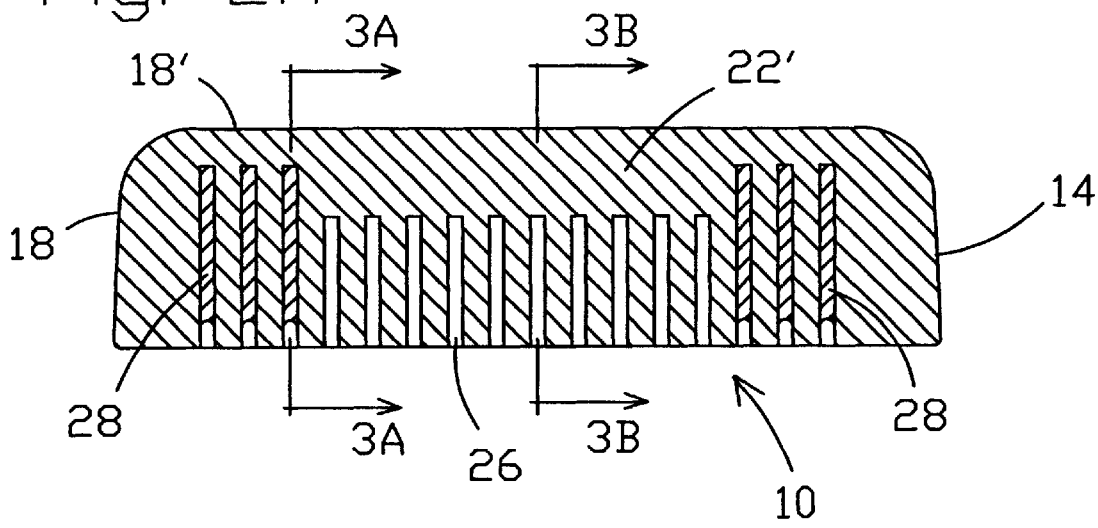
FIG. 2A is a top sectional view of the putter head taken along line 2A of FIG. 1A.
Figure 3A:
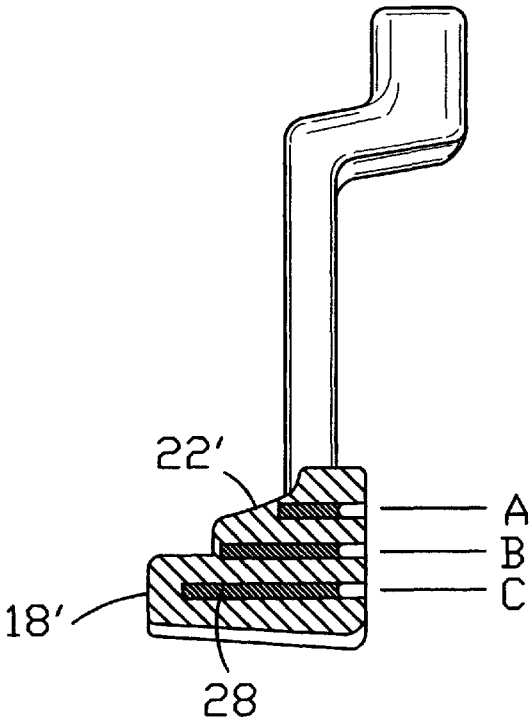
FIG. 3A is a sectional end view taken along line 3A of FIG. 2A.
Figure 3B:
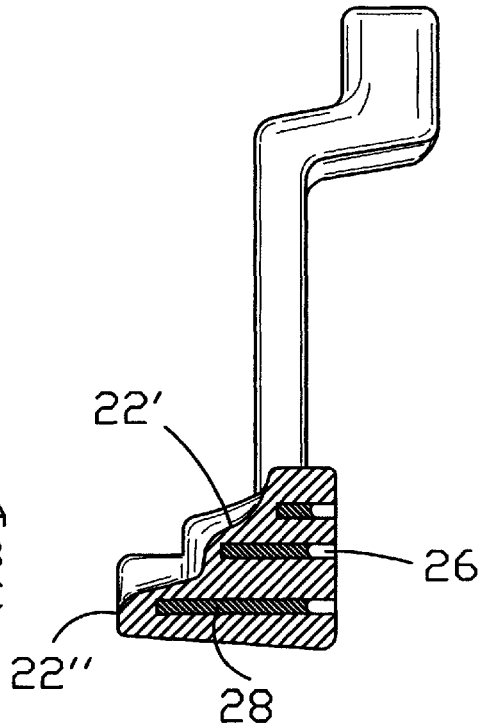
FIG. 3B is a sectional end view taken along line 3B of FIG. 2A.
Figure 5:
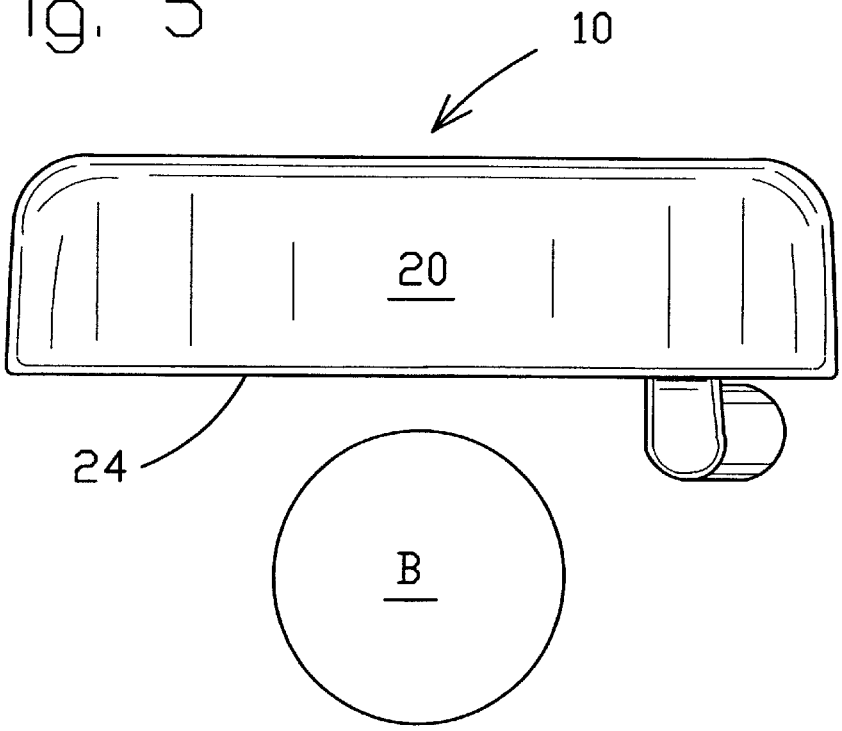
FIG. 5 is a bottom view of the putter head in relation to a golf ball.
Figure 6:
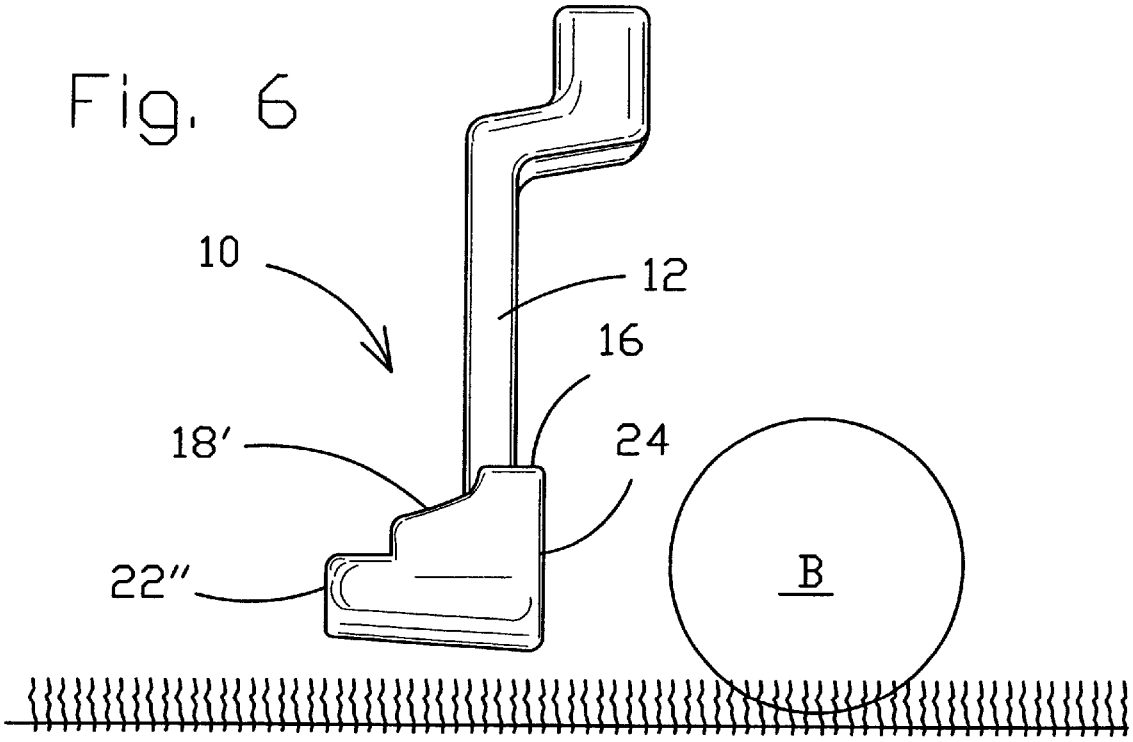
FIG. 6 is a side view of the putter head and golf ball.

Turning now to FIGS. 2 and 3, specifically, FIG. 2A is a cut away view taken along line 2A of FIG. 1A which shows a first arrangement of apertures 26 forming horizontal row C or the row adjacent sole 20. As shown, the outer three apertures extend to a depth greater than those apertures between wedges 18' and heel 14'. This arrangement is possible as these outer apertures which are along horizontal row C are drilled into the wedges as shown in FIG. 3A. The remaining apertures or those between wedges 14', 18' terminate in plate 22" at a greater distance from the back surface of the putter head.

Filler 28 is provided for insertion into apertures 26. Filler 28 is preferably formed of a powdered metal, powdered graphite or graphite and plastic or of a combination powdered metal and plastic. Powdered lead or lead and thermoplastic are suitable materials. It is important that the weight per unit volume of the filler be greater than that of the putter head forming material. This allows the weight of specific areas of the putter head to be selectively increased by adding filler without altering the size, shape or appearance of the putter head. Alternately, the weight of the same area may be decreased simply by forming the apertures and not adding filler.

Filler 28 is generally placed in the selected apertures up to a point just short of face 24. This provides face 24 with a uniform surface for contact with the golf ball. Generally the filler is added to the heel and toe areas to provide a desired increase weight in this region. Another area usually provided with additional weight is along horizontal row C to provide additional weight along the sole. Clearly though the filter may be added to any desired area to control the club balance as desired.

FIG. 2B shows another common arrangement of apertures arranged along horizontal row C of FIG. 1A. Here apertures 26 are drilled to a common depth across the putter face. Again filler 28 is added to the outer most apertures while the center ones remain void as drilled. FIG. 2C shows an aperture arrangement along line 2C of FIG. 1B. Here the apertures 26 adjacent the heel and toe 14, 18 are drilled to a minimal depth while those in the center area of face 24 are drilled to a depth two to three times deeper. This arrangement also increases the heel/toe weight relative to the center area weight.

While a preferred embodiment of the invention has been described using specific terms, such description is for illustrative purposes only, and it is to be understood that changes and variations may be made without departing from the spirit or scope of the following claims.

What is claimed is:

1. A putter comprising:

a putter head formed of a first material having a heel, a toe, a face a back, a top and a sole, said face including a designated impact surface for a golf ball;

said face comprising a generally planar surface extending from said heel to said toe and from said top to said sole;

a plurality of horizontal rows of apertures formed along substantially horizontal planes over substantially the entire surface of said face and into a body area between said face and said back, said apertures being of selected and different depths depending upon their location on said face, said apertures further being of selected diameter and spacing, whereby, said impact surface of said face is softened and the distribution of weight over said putter head is selectively controlled.

2. The putter head of claim 1 wherein said apertures are formed to different depths between horizontal planes.

3. The putter head of claim 1 wherein said apertures are formed to different depth along vertical planes.

4. The putter head of claim 1 wherein said apertures are formed to different depths along said horizontal planes.

5. The putter head of claim 1 wherein said back of said putter head is shaped to include a ridge.

6. The putter head of claim 1 wherein said putter head is a cavity back putter head.

7. The putter head of claim 1 wherein said face comprises a smooth surface having a plurality of horizontally and vertically aligned apertures.

8. The putter head of claim 1 wherein said cavities between said heel and said toe are of different depths between horizontal rows.

9. The putter head of claim 1 wherein said cavities in said heel and toe are of different depths along vertical rows.

10. The putter head of claim 1 including a filler of a second material having a weight per unit volume different from the weight per unit volume of said first material, said filler only partially filling certain of said apertures.

11. The putter head of claim 10 wherein the weight per unit volume of said filler is greater than the weight per unit volume of said first material.

12. The putter head of claim 10 wherein said certain apertures comprise apertures adjacent said toe and said heel.

13. The putter head of claim 10 wherein said filler fills said certain apertures to be a selected uniform depth.

14. The putter head of claim 10 wherein said filler fills said certain apertures to be of selected varying depths.

15. The putter head of claim 10 wherein said certain apertures comprise the lower of said horizontal rows of apertures.

16. A putter head formed of a first material:

said putter head having a heel, a toe, a face, a back, a top and a sole;

said face comprising a generally smooth planar surface extending from said heel to said toe and from said top to said sole;

a plurality of horizontal rows of apertures formed over said face along substantially horizontal planes and extending into a body area between said face and said back, said apertures being of selected and different depths along selected ones of said horizontal rows depending upon their location on said face;

a filler of a second material having a weight per unit volume different from the weight per unit volume of said first material, said filler partially filling said apertures to selected depths of at least the lower of said horizontal rows and said apertures adjacent said toe and said heel, wherein, said face provides a uniform striking surface while the weight, weight distribution and balance of said putter is adjusted as desired.

* * * * *